US005784842A

United States Patent [19]

Wackerbauer

[11] Patent Number: 5,784,842

[45] Date of Patent: Jul. 28, 1998

[54] ROOF ARRANGEMENT COMPRISING TARPAULINS AND A PLURALITY OF LATTICE GIRDERS

[75] Inventor: Anton Wackerbauer, Martinsried, Germany

[73] Assignee: WACO, Wackerbauer & Co., Eichenau, Germany

[21] Appl. No.: 682,210

[22] Filed: Jul. 17, 1996

[30] Foreign Application Priority Data

Jul. 18, 1995 [DE] Germany ..... 195 26 197.6

[51] Int. Cl.[6] ..... E04B 1/18

[52] U.S. Cl. ..... 52/222; 52/63; 52/654.1; 52/655.1

[58] Field of Search ..... 52/633, 222, 643, 52/691, 692, 644, 639, 729.2, 18, 13, 6, 63, 273, 636, 638, 651.09, 652.1, 654.1, 655.1, 690; 160/327, 368.1, 369

[56] References Cited

U.S. PATENT DOCUMENTS 5,263,296 11/1993 Spera ..... 52/638

5,333,425 8/1994 Nickerson et al. ..... 52/63 X 5,335,468 8/1994 Oberman et al. ..... 52/690 X

FOREIGN PATENT DOCUMENTS 2815848 10/1978 Germany ..... 52/222

874933 10/1981 U.S.S.R. ..... 52/222

*Primary Examiner*—Creighton Smith

*Attorney, Agent, or Firm*—Townsend and Townsend and Crew

[57] ABSTRACT

A lattice girder (11) has an upper chord (12), a middle chord (13) and a lower chord (14) between which stiffening struts (15, 16) extend. Furthermore, at least one piping groove (17, 17', 18, 18') is provided at the middle chord (13) at at least one side of the lattice girder (11) and extends parallel to the longitudinal extent. The pipings (19) of the tarpaulin(s) (20, 20') are drawn into the piping groove in the longitudinal direction. In acchordance with the invention two piping grooves (17, 18; 17', 18') are provided above one another at at least one side and preferably on both sides of the middle chord (13).

27 Claims, 6 Drawing Sheets

ROOF ARRANGEMENT COMPRISING TARPAULINS AND A PLURALITY OF LATTICE GIRDERS

FIELD OF THE INVENTION

The invention relates to a roof arrangement comprising at least one tarpaulin and a plurality of lattice girders or grid beams supported on a substructure which are arranged alongside one another, and accommodate the tarpaulin(s) between them, the lattice girders having an upper chord, a middle chord, and a lower chord, between which struts extend and having at least one piping groove on at least one side of the lattice girder at the middle chord which extends parallel to the longitudinal extent of the lattice girder and into which the piping of the tarpaulin(s) is drawn in in the longitudinal direction. The invention also relates to a lattice girder comprising an upper chord, a middle chord, and a lower chord, between which mounting struts extend and at least one piping groove on at least one side of the middle chord which extends parallel to the longitudinal extent, and into which the piping of a tarpaulin is drawn in the longitudinal direction.

DESCRIPTION OF PRIOR ART

Roof arrangements with the lattice girders and tarpaulins stretched between them are already known in various embodiments (German utility model 82 30 404 U1). With a roof arrangement or with a lattice girder of the initially named kind (German utility model 86 17 398 U1) three or four beam chords are provided which are arranged above one another and which can be provided with piping grooves at both sides for the drawing in of the bead-like pipings of the tarpaulins.

In this manner cross connectors can be arranged between individual lattice girders above a drawn-in tarpaulin, whereby it is made easier and safer for people to walk about above the tarpaulin. Further components, such as, for example, carrier structures or scaffolds, can be arranged beneath the tarpaulins.

When using four chords the relatively large vertical spacing of the tarpaulins which are drawn into the upper or lower of the two inner chords is disadvantageous, as is in the presence of a total of three grid constructions arranged above one another, which leads to a large overall height. The large spacing of the middle chords is brought about by the system because the middle framework which is stiffened by vertical and diagonal struts determines the load-carrying ability of the beam. The requirement to bridge a large span makes a large spacing of the two inner chords inevitable. In contrast, the fields at the top and at the bottom, which are only equipped with vertical struts, only contribute insignificantly to the load-carrying ability. They primarily serve only for the connection of further components.

With three chords only one tarpaulin can be drawn in or the upper and lower connection elements are lost.

OBJECT OF THE INVENTION

The object of the present invention is to provide a roof arrangement or a lattice girder of the initially named kind in which a better stiffness is achieved with fewer chords and in which ideal possibilities are present both above and also beneath the tarpaulins for the connection of further constructions, connectors and/or scaffold parts, with the space required to accommodate a plurality of overlapping tarpaulins being minimised.

BRIEF DESCRIPTION OF THE INVENTION

In order to satisfy this object of the invention provides a roof arrangement and a lattice girder of the initially named kind which are characterised in that a plurality of piping grooves, preferably two piping grooves are provided on at least one side of the middle chord and preferably on both sides of the middle chord.

The concept underlying the invention is thus to be seen in the fact that, for the purpose of making available extended connection possibilities both above and also underneath the tarpaulins, only three vertically spaced apart chords are provided but a plurality of piping grooves, and in particular of two piping grooves arranged above one another, are provided on at least one side of the closed middle chord and can be selectively used for the drawing in of the bead of the piping of only one tarpaulin or of several tarpaulins, in particular of two tarpaulins.

If tarpaulins are drawn in an overlapping manner into the upper and lower piping grooves then the vertical difference resulting from the arrangement of two piping grooves on a single middle chord is so small that it can in practice be ignored. Nevertheless, the vertical spacing is sufficient for the tarpaulins, whose pipings are arranged in piping grooves lying above one another, to overlap without touching. If two tarpaulins are arranged above one another, for example for the purpose of better insulation, then no lateral airflows can arise between the tarpaulins at the middle chord because of the closed middle chord.

Thus, in accordance with the invention, the full beam height can be exploited statically so that further components can be attached both to the top and also to the bottom. In accordance with the invention a substantial saving of material thus arises without the stability and the numerous connection possibilities for further components being impaired.

In accordance with the invention the advantageous possibility also exists of connecting the lattice girder at its outermost end to the substructure at the eaves so that the length of the beam can be exploited ideally.

In a preferred embodiment the spacing of the chords perpendicular to the longitudinal extent of the lattice girder amounts to a multiple, preferably from three to six times, and in particular from four to five times the thickness of the middle chord perpendicular to the longitudinal extent and in the plane of the lattice girder. This embodiment is expedient for the purpose of improved stability of the overall arrangement, with a small spacing of several overlapping tarpaulins.

In another preferred embodiment the middle chord has a rectangular box section, with the piping grooves arranged above one another being provided at its long sides. This is advantageous in order to provide adequate space at the middle chord for the piping grooves arranged above one another and for reasons of stability.

When the upper chord and the lower chord have the same spacing from the middle chord, equivalent frameworks are advantageously present both above and also beneath the middle chord and are universally suited for the stable connection of further components.

Whereas the middle chord represents an elongate section which is closed at all sides and preferably formed as a box, a framework having suitable struts extends above it and below it.

It is particularly advantageous when both connection/mounting struts extending perpendicular to the longitudinal direction for the attachment of further components and also oblique stiffening struts extending at a significant angle of, for example, 30° to 60° and in particular of approximately 45° to the longitudinal direction are located between the chords. In this design the frameworks between the chords have a double function and serve as connection elements for further components and as stiffening means for the lattice girder. The presence of a stiffening framework both above and also beneath the middle chord is particularly favourable for the overall strength.

The lattice girder preferably consists of two halves which are mirror-symmetrical to its central longitudinal axis. This is of advantage because in this way the manufacture of the lattice girder from unitary components is made easier.

Whereas the formation of two piping grooves arranged above one another at one side could be sufficient for end lattice girders, it is preferable for two piping grooves to be arranged above one another at the same spacing on the centre chord on each side and to be respectively mutually aligned in the lateral direction, because these lattice girders can be universally used.

Connection/mounting struts are preferably provided with a diameter and a spacing which permits the attachment of series components, such as cross-connectors, support constructions, or scaffolds with self-securing connections or scaffold couplings. This facilitates the connection of cross connectors and other components.

In order to instal a modular system it is preferably for each lattice girder to be sub-divided in the longitudinal direction into individual lattice girder sections which can be connected at their ends into a component unit, in particular through a plug connection which can, if necessary, be secured by screws or other fastening means. In order to provide a lean-to or shed roof it is sufficient if only a single type of lattice girder section is provided. If, however, one wishes to realise ridged roofs which can have an inclination of, for example, 15° to the horizontal, then a ridge frame should be additionally provided, i.e. a part of the lattice girder is formed as a ridge frame.

In a particularly advantageous embodiment one and in particular two connection/mounting struts are provided at the end of each beam section, which are in particular aligned with one another, and extend perpendicular to the longitudinal extent of the lattice girder. At the other end of the lattice girder sections the last mounting strut or the last mounting struts are so far removed from this end in the longitudinal direction that each lattice girder section is formed asymmetrically relative to its central plane extending perpendicular to the longitudinal direction and, after the plugging together of two lattice girder sections, all connection/mounting struts in the longitudinal direction of the lattice girder have the same spacing. In this design the middle chord preferably projects at one end in the longitudinal direction so far beyond the upper and lower chords, which are of the same length and aligned with one another, that the oblique stiffening struts, which terminate at this end, are of the same shape and are arranged as the remaining struts extending parallel thereto. The middle chord is correspondingly set back at the opposite end relative to the top and bottom chords. Despite the inward displacement of the outer vertical bar to the inside, a lattice girder arrangement is achieved on putting together the individual lattice girder sections, in which all vertical struts have the same spacings in the longitudinal direction. In this way standardised stiffening material can be used and diagonal struts of the same length can be installed throughout the region of the beam.

The combination of the two advantages is particularly advantageous in as much as the lattice girder can be connected at its outermost end to the substructure at the eaves and in this way the beam length can be ideally exploited. Despite the inward displacement of the outer vertical beam the same spacings of the vertical bars can be achieved even with assembled lattice girder sections.

The combination of these two advantages is thus achieved by an asymmetric design of the lattice girder section. All three chords have, however, the same length, the upper and lower chords are, however, arranged displaced relative to the middle chord. In this way the upper and middle chords project at one end of the beam beyond the last vertical to such an extent that a connection of the beam to the subconstruction is possible at the outermost end and thereby the beam length can be fully exploited in order to achieve an ideal span. At the other end of the beam the upper and lower chords are set back by the corresponding amount, whereas the middle chord projects outwardly in order to be able to receive the diagonal stiffeners. These stiffeners can then have the same length for the entire beam.

It is particularly preferred when at least one and preferably two oppositely disposed parallel piping grooves are provided above the already present piping grooves on the middle chord. A tarpaulin which spans the ridge can be drawn into these further piping grooves so as to cover over the gap which remains when one draws tarpaulins from both sides of the ridge into the lower lying piping grooves, which only extend up to but short of the ridge.

As a result of this design two tarpaulins can be drawn behind one another and overlapping one another into the piping grooves which extend over the normal lattice girders. The gap at the ridge at the top can nevertheless be protected against the penetration of rainwater by a ridge cover tarpaulin.

An essential concept of the invention is to be seen in the fact that the piping grooves which are provided above one another are not only provided in order to be able to selectively arrange continuous tarpaulins at different vertical levels but rather in particular so that tarpaulins are arranged both at the lower piping groove and also at the upper piping groove. Thus tarpaulins are provided in both piping grooves over at least part of their length and are arranged above one another.

If one proceeds in this way with continuous tarpaulins provided above one another over at least part of their length then a double roof skin is present, which is not only of importance for the overall roof arrangement but rather also favours the heat insulation of the roof arrangement.

In a preferred design a tarpaulin is arranged in the lower region in the lower piping groove and extends only over a part of the length of the lattice girder. A further tarpaulin is then arranged in the upper region in the upper piping groove and extends over the remainder of the length of the lattice girder and also overlaps the lower tarpaulin. This is of especial advantage because in this way one can operate with shorter tarpaulins which overlap at the joint positions so that no sealing problems arise. Ventilation is automatically provided in an advantageous manner at the position of overlap for the space covered over by the roof arrangement, without the danger existing that moisture can penetrate there into the interior because the degree of overlap can be correspondingly selected.

The provision of two piping grooves arranged above one another in the ridge region is furthermore of advantage because it is generally difficult to guide a continuous tarpaulin provided with piping beads at the edge over the ridge region on both sides of the roof. This is due to the large frictional resistance in the region of curvature of the ridge.

A preferred embodiment comprising a ridge frame is characterised in that tarpaulins ending in the ridge region are provided at the lower piping grooves and a tarpaulin which overlaps the two lower tarpaulins is provided in the upper piping grooves of the ridge frame. As a result of this arrangement, continuous tarpaulins can be guided in the piping grooves in a straight line on both sides of the ridge from the underside approximately up to the ridge. The gap which remains in the ridge region is then covered over by a short piece of tarpaulin which is inserted into the upper piping grooves in the ridge region. This short tarpaulin overlaps the tarpaulins with straight piping which extend to the ridge from both sides in the manner which is necessary to avoid the penetration of moisture.

When the tarpaulins which extend to the ridge from both sides sealingly merge into one another in the upper piping groove at the ridge then it is advantageous to draw a special ridge cover tarpaulin into the ridge piping groove located above it.

The invention thus provides not only a roof arrangement and a lattice girder with ideal connection possibilities both at the upper side and also at the lower side of the tarpaulin(s) but also provides an extremely universal arrangement for the placement of two tarpaulins with a small vertical difference and largely independently of one another.

The structure of the invention or the lattice girders of the same can optionally be used also as a wall arrangement by mounting them vertically.

BRIEF LISTING OF FIGURES

The invention will be described in the following by way of example and with reference to the drawings in which are shown:

FIG. 1 a side view of a lattice girder intended for a roof arrangement in accordance with the invention, FIG. 2 a corresponding side view of a ridge frame part in accordance with the invention, FIG. 3 an enlarged sectional view in accordance with lines III—III in FIGS. 1 and 2, FIG. 3*a* a partial perspective view of a roof arrangement according to the invention using the lattice girders as shown in FIGS. 1–3, FIG. 4 a view analogous to FIG. 2 of a further, particularly preferred embodiment of a ridge frame part in accordance with the invention, FIG. 5 a schematic sectional view in accordance with line V—V in FIG. 4, FIG. 5*a* a partial perspective view of a roof arrangement according to the present invention using lattice girders as shown in FIGS. 4 and 5, and FIG. 6 a view analogous to FIG. 1 of a further, particularly advantageous embodiment of a lattice girder section in accordance with the invention.

DESCRIPTION OF PREFERRED EMBODIMENTS

Figure 1:
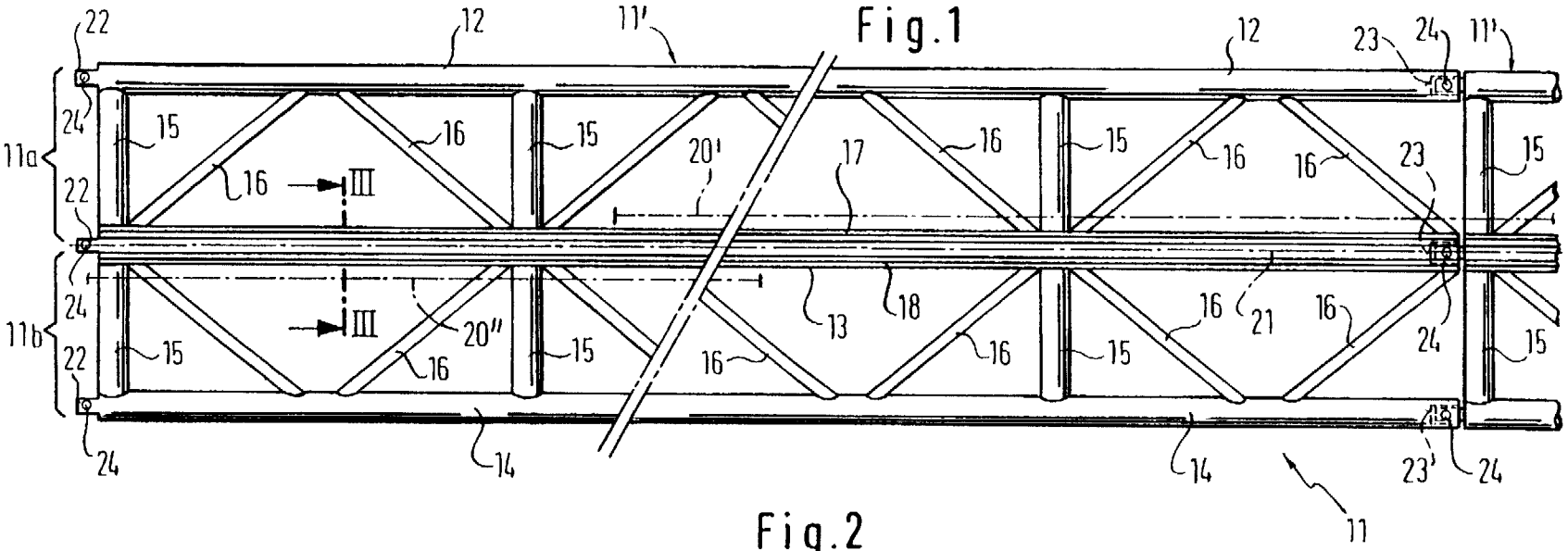
Figure 3:
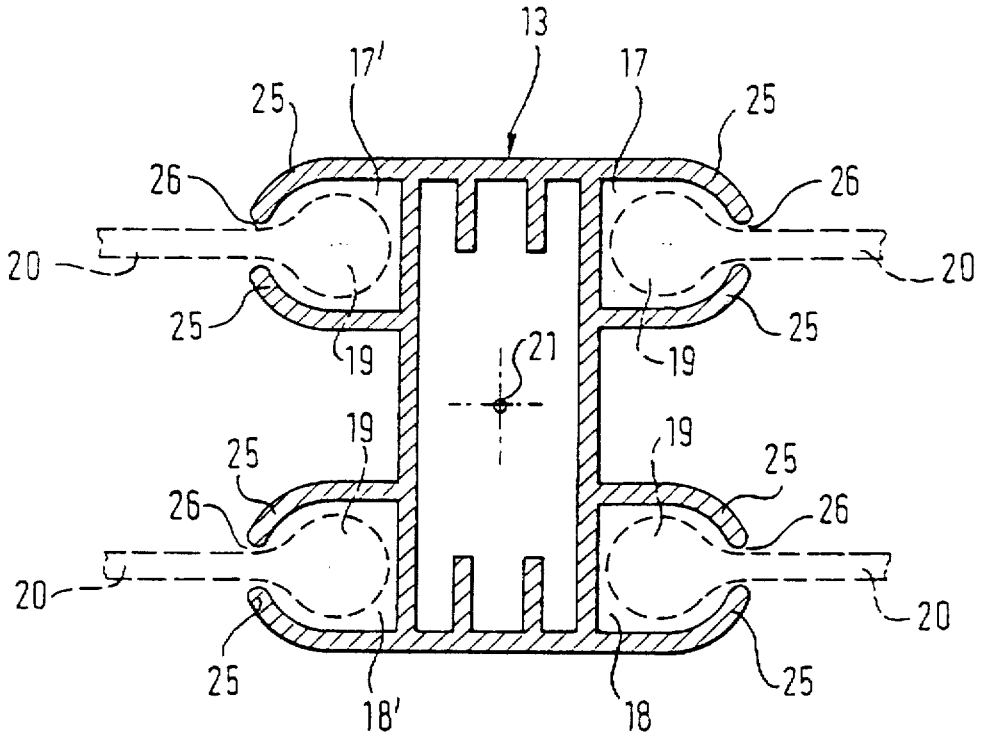

In accordance with FIG. 1 a lattice girder 11 in accordance with the invention consists of individual lattice girder sections 11' of identical design, which respectively consist of a straight and in particular tubular upper chord 12, a middle chord 13 having a box section in accordance with FIG. 3, and a straight, preferably tubular lower chord 14 which all lie in one plane and are connected into a stable constructional unit by connecting mounting struts 15 arranged at uniform intervals and extending perpendicular to the chords 12, 13, 14 and by oblique stiffening struts 16 arranged therebetween.

As a result of the symmetrical arrangement of FIG. 1 the lattice girder sections 11' shown there consist of two halves 11*a*, 11*b*, which are arranged with mirror symmetry to one another.

At opposite ends the lattice girder sections 11' have plug projections 22 and socket recesses 23 complementary thereto by means of which two lattice girder sections 11' can in each case be connected into a lattice girder construction unit 11 which is twice as long.

After the plugging together of two lattice girder sections 11' the plug connections 22, 23 can be fixed through screw holes 24 provided for this purpose in the plug projections 22 and in the area of the socket recesses 23.

Figure 2:
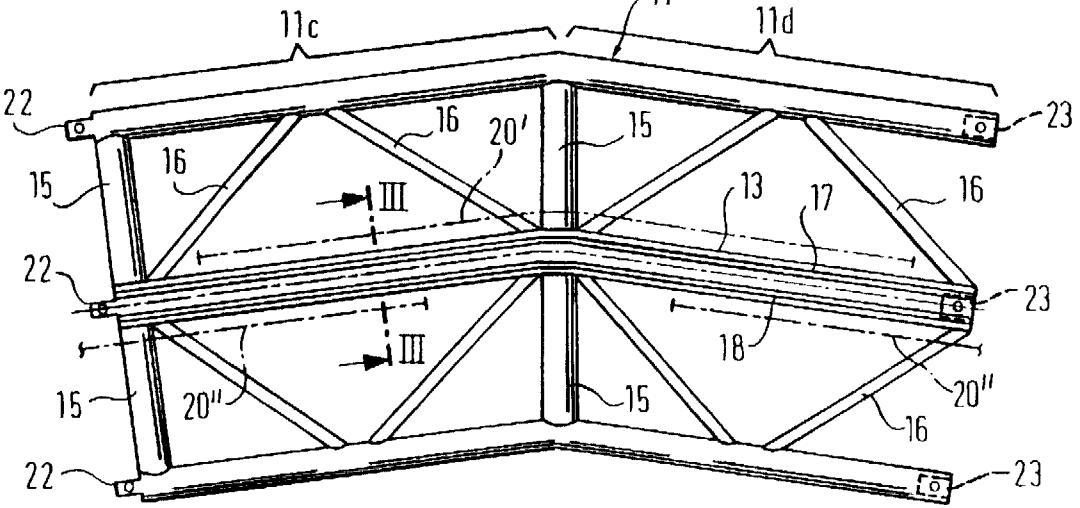

In accordance with FIGS. 1 to 3 pairs of receiving projections 25 are arranged at the sides on the middle chord having a box section at the top and at the bottom and together each form a piping groove 17, 17' and 18, 18' respectively. A piping groove will be understood to mean a hollow cavity which extends in the axial direction and which is connected to the surrounding atmosphere by a slot 26, having a substantially smaller extent in the vertical direction than the inner receiving space of the piping grooves 17, 17' or 18, 18'. The piping groove 17, 17' or 18, 18' are open at the axial ends of the lattice girder sections 11' so that the bead or piping 19 of a tarpaulin 20 can be drawn in from there, as is indicated in broken lines in FIG. 3.

In accordance with FIG. 1 each lattice girder section 11' is built up symmetrically to the central axis 21 of the lattice girder 11. This also applies to the middle chord 13 of FIG. 3 with respect to the piping grooves 17, 17' and 18, 18' respectively.

The connection/mounting struts 15 are arranged at uniform intervals with the subdivision of the lattice girder 11 into lattice girder sections 11' being such that this same spacing of the connection/mounting struts 15 is also maintained when a plurality of lattice girder sections 11' are connected together in accordance with FIG. 1.

FIG. 2 shows a lattice girder section 11" which is intended for arrangement in the ridge and which consists of two parts which extend in accordance with the roof inclination on both sides of the ridge and which have parts 11*c* and 11*d* at an angle to one another, which are connected together to form a rigid constructional unit.

The chords 12, 14 and also the connection/mounting struts 15 preferably consist of round tubes with an outer diameter of 48 mm. The length of the individual lattice girder sections 11' should amount to 4.5 to 6 m.

Figure 3A:
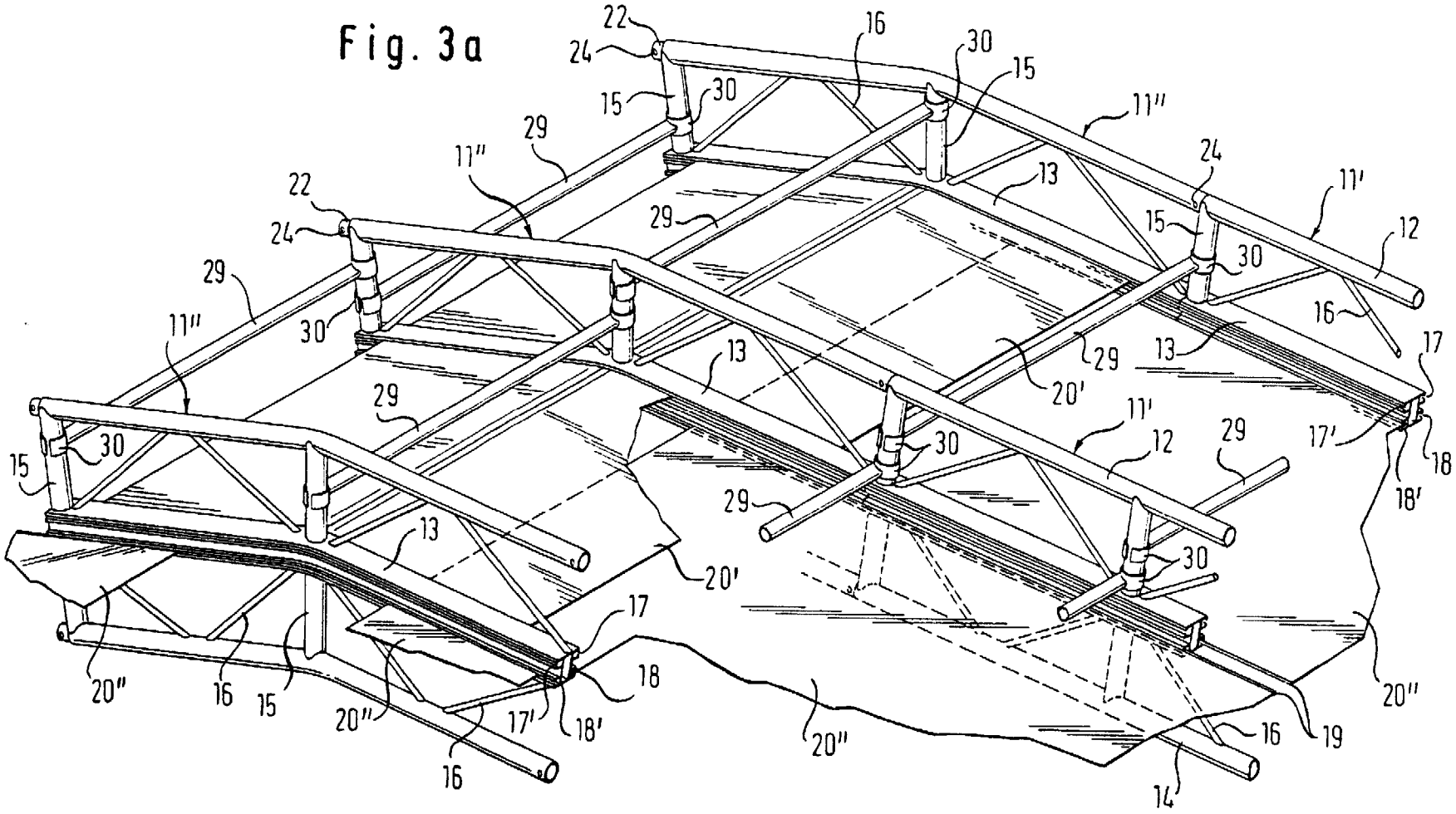

The operation of the lattice girder, or of the roof arrangement made from it, is as follows:

For the covering over of a specific space the required number of lattice girder sections 11' is first selected and plugged together and also fixedly connected together to form larger constructional units. Furthermore—if required—a ridge part 11" in accordance with FIG. 2 is provided and is plugged together with the adjacent lattice girder sections 11'. Then the entire lattice girder 11 is installed on a corresponding scaffold or substructure. According to FIG. 3*a* the individual neighboring lattice girders 11 are expediently connected together by cross connectors 29 to form a stable unit, with the cross connectors 29 respectively acting by means of clamping claws 30 on the upper connection/mounting struts 15. This also simultaneously provides a possibility for walking on the upper side of the roof.

Thereafter, the pipings 19 of tarpaulins 20 are drawn into the upper and/or lower piping grooves 17, 17' and 18, 18' respectively from the open underside in order to form a roof skin.

Through the arrangement of tarpaulins 20 at both the upper and also the lower piping grooves 17, 17' and 18, 18' respectively, a double roof skin can be realized in this way in a simple manner. It is also possible to first draw in one tarpaulin from the eaves into only the lower piping grooves 18, 18' up to a predetermined length and then to accommodate a further tarpaulin in the upper piping grooves 17, 17', with the two tarpaulins then overlapping one another.

If a first lattice girder 11" is used then a tarpaulin is drawn in from both sides approximately up to the ridge only in the lower piping grooves 18, 18'. The gap above it is then bridged by tarpaulins drawn into the upper piping grooves 17, 17'. This arrangement is indicated in chain dotted lines in FIG. 2 beneath and above the piping grooves 17 and 18 respectively and also on FIG. 3*a*.

The overlapping of tarpaulins 20' and 20" drawn into the upper piping grooves 17 and into the lower piping groove 18 is likewise indicated in FIG. 1 by chain dotted lines above and below the actual piping grooves 17, 18.

Figure 4:
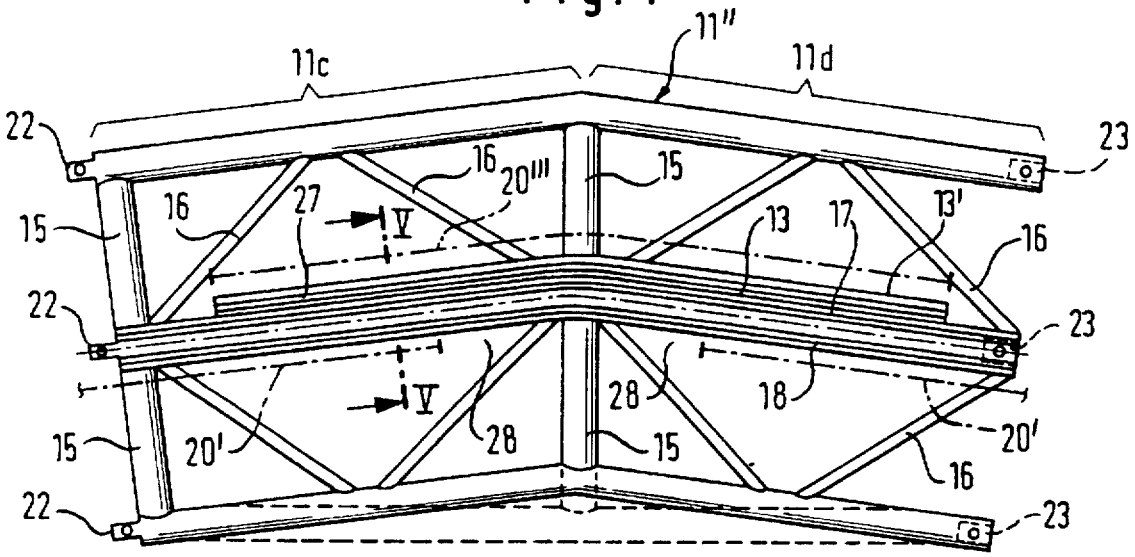
Figure 5:
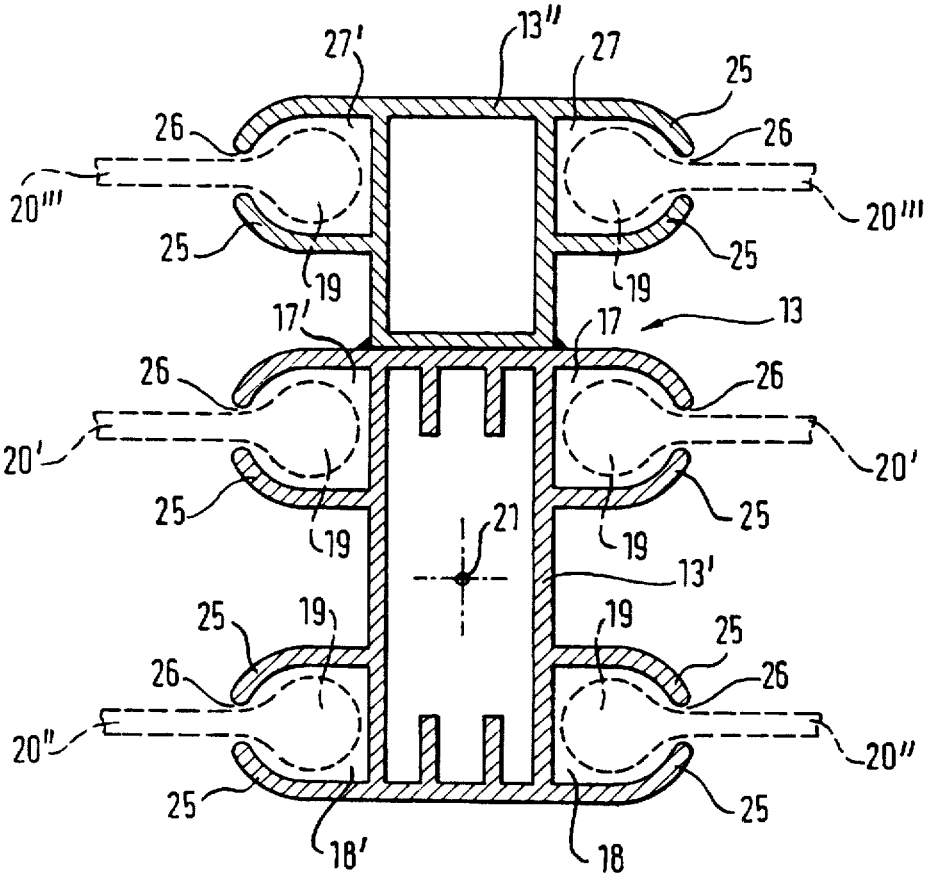
Figure 5A:
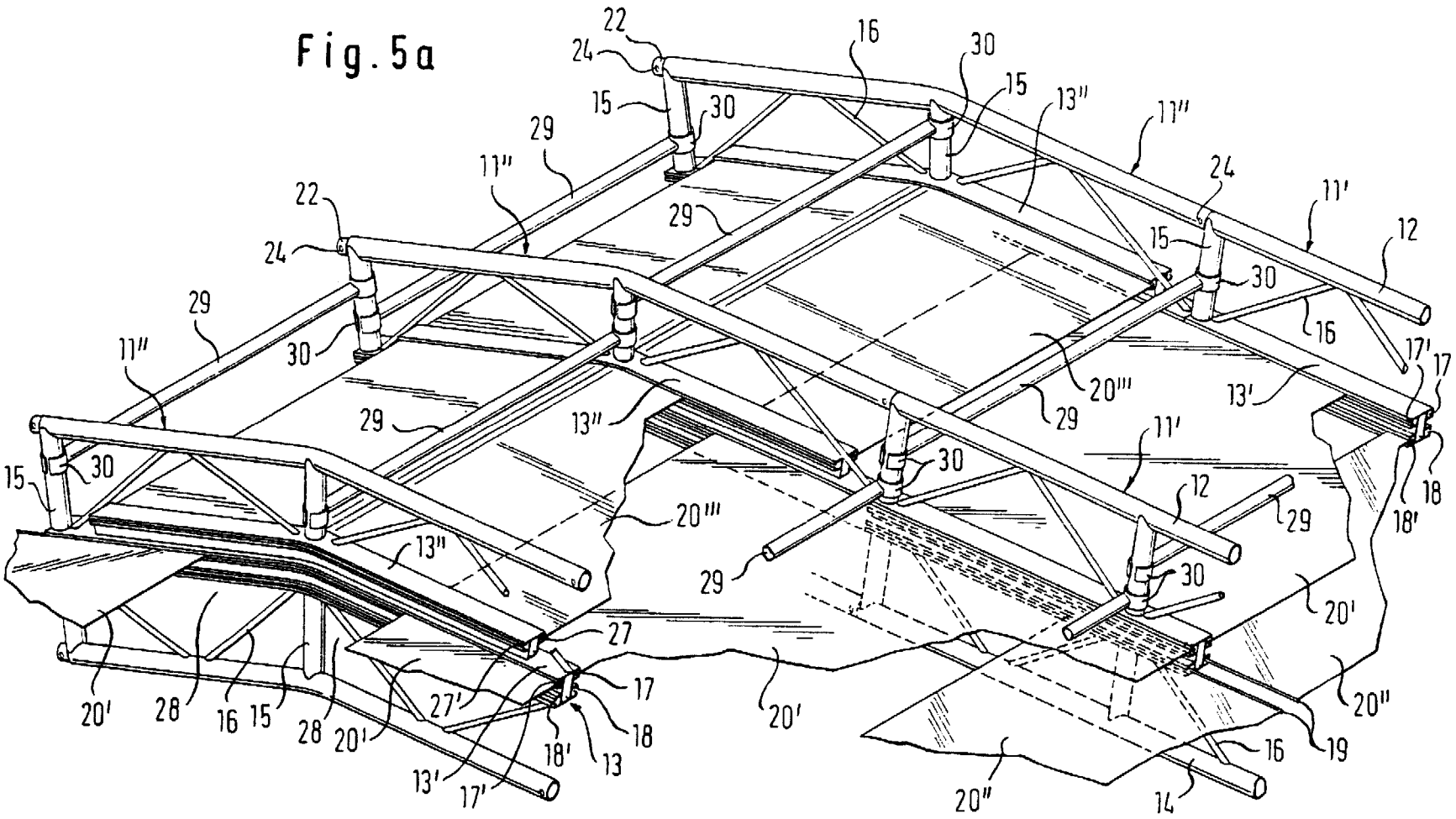

In the embodiment of FIGS. 4, 5 and 5*a* the middle chord 13 consists of a main middle chord part 13' and a chord-like top 13" which can, for example, be welded on and which, in accordance with FIG. 4, follows the ridge shape of the lattice girder for the ridge and also likewise has piping grooves 27, 27' at its two oppositely disposed sides into which a ridge cover tarpaulin 20'" can be drawn.

In this manner it is first possible to draw in a tarpaulin of 5 m length into the lower region of the lattice girder into the lower piping grooves 18, 18', as is indicated in FIGS. 1 and 5 at 20". A second tarpaulin 20' is then drawn into the upper piping grooves 17, 17', with its end overlapping the first tarpaulin 20" but, however, only extending—as shown in FIG. 5*a* and in chain dotted lines in FIG. 4—approximately to the ridge where a gap 28 remains. This gap can now be covered over in accordance with the invention in that a ridge cover tarpaulin is drawn into the piping grooves 27, 27' as shown in FIG. 5*a*, in chain dotted lines in FIG. 4, and indicated in broken lines in FIG. 5 at 20'".

Thus three piping grooves 17, 18, 27 and 17', 18', 27' are preferably arranged above one another on the lattice girder at each side, at least, however, on one side. As a result of the arrangement of the third piping groove 27, 27' in the ridge region it is possible to make do with standard tarpaulins with a length of, for example, 5 m for the cover. A precise adaptation to the overall span of the lattice girders can be effected when using standard tarpaulins of a predetermined length through a differential overlap (as can be recognized at 20' in FIG. 1).

The invention thus makes it possible to avoid having to make special tarpaulins for the lattice girders of the invention and also to avoid having to use tarpaulins which are too large, in particular too long, which would make them difficult to handle.

As a result of the design of the invention in accordance with FIGS. 4, 5 and 5*a* all spans from 10 m to 20 m can be reliably covered without the danger of rain entering, using a 5 m standard tarpaulin 20', 20" and a smaller ridge tarpaulin 20'".

Figure 6:
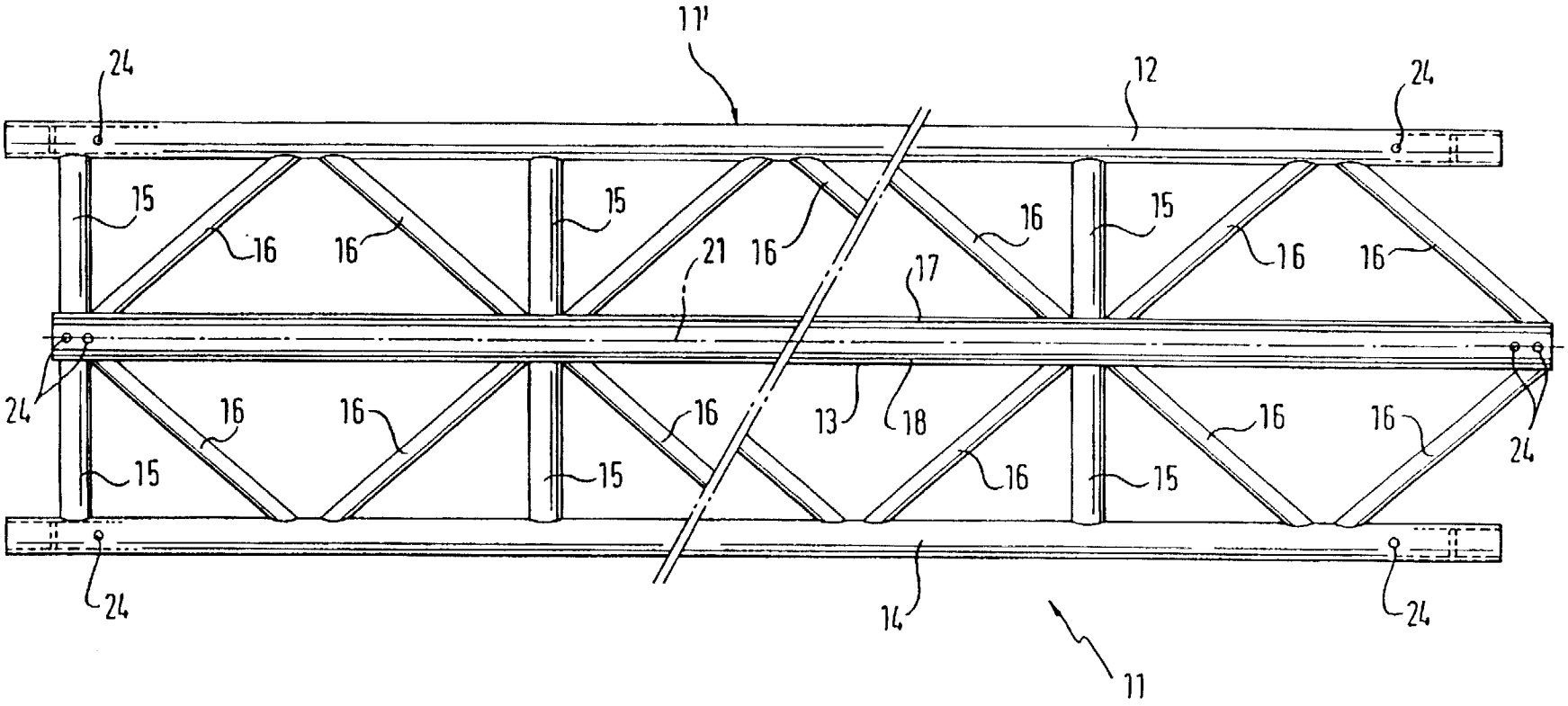

In accordance with FIG. 6 the middle chord 13 is made somewhat longer at the right-hand end of the lattice girder section 11', where the connection/mounting struts 15 extending perpendicular to the longitudinal direction are clearly somewhat removed from the end than the top and bottom chords 12 and 14. The top and bottom chords are of the same length. The middle chord 13 projects further outwardly in such a way that the oblique stiffening struts 16 which extend to the end of the middle chord 13 can have the same length and also the same angle as the parallel oblique stiffening struts 16 arranged further inwardly in the beam.

Accordingly, the middle chord is somewhat shorter than the upper and lower chords 12 and 14 respectively, at the opposite left-hand end, where it lies practically flush with the connection/mounting struts 15. At the left hand the upper and lower chords extend axially somewhat beyond the mounting struts 15.

As a result of this design of the lattice girder section 11' all three chords 12, 13, 14 have the same length but the upper and lower chords 12 and 14 are, however, somewhat displaced in the longitudinal direction of the beam relative to the middle chord 13. In this way the upper chord 12 and the lower chord 14 project at the left end in FIG. 6 beyond the mounting struts 15 in the longitudinal direction to the left to the extent that a connection of the beam to the subconstruction is possible at the outermost end. The mounting struts 15 lie flush with the left-hand end of the middle chord 13. In this way the beam length can be fully exploited to achieve an ideal span. At the other right-hand beam end in FIG. 6 the top and bottom chords 12 and 14 are set back by the corresponding amount relative to the middle chord, whereas the middle chord 13 in accordance with FIG. 6 projects somewhat to the right in the longitudinal direction of the beam in accordance with FIG. 6 so that the diagonal stiffening struts 16 can have the same length and the same angle with the same design as the remaining parallel struts 16.

The embodiment of FIG. 6 also opens up two important advantages, namely the possibility of connection to the substructure at the left-hand end and the identical design of all oblique stiffening struts 16 which extend parallel to one another.

Reference Numeral List

11 lattice girder
11' lattice girder section
11" ridge frame
12 upper chord
13 middle chord
13' main middle chord part
13" cap piece
14 lower chord
15 connection/mounting strut
16 oblique stiffening strut
17 piping groove
17' piping groove
18 piping groove
18' piping groove
19 piping (bead)
20 tarpaulin
20' extent of the upper tarpaulin
20" extent of the lower tarpaulin
21 central longitudinal axis
22 plug projection
23 socket recess
24 screw holes 25 mounting projections
26 slot
27 piping groove
27' piping groove
28 gap

I claim:

1. A roof arrangement for suspending a plurality of tarpaulins in overlapping arrangement between a plurality of lattice girders, the roof arrangement comprising in combination:

a plurality of tarpaulins, each tarpaulin having at least a central tarpaulin expanse and paired parallel edges, each of the paired parallel edges having pipings defining expanded thickness to the tarpaulin expanse at the edges thereof;

at least a pair of side-by-side spaced apart lattice girders, each of the lattice girders including, an upper elongate chord;

a lower elongate chord underlying the upper elongate chord;

a medial elongate chord disposed between the upper elongate chord and the lower elongate chord;

interconnecting members extending between the upper elongate chord, the lower elongate chord and the medial elongate chord for fastening said members into the lattice girder;

at least an upper groove member attached to the lattice girder opening at least to one side of the lattice girder to receive and retain a first tarpaulin piping with the tarpaulin extending from the groove member; and, at least a lower groove member attached to the lattice girder opening at least to the one side of the lattice girder to receive and retain a tarpaulin piping with the tarpaulin extending from the groove member;

the respective groove members facing one another from the side-by-side spaced apart lattice chords;

a first tarpaulin threaded at the pipings to the upper groove member of the lattice girders; and, a second tarpaulin threaded at the pipings to the lower groove member of the lattice girders;

whereby when the lattice girders are spaced side-by-side, respective first tarpaulins and second tarpaulins are placed in the upper groove member and in the lower groove member to at least overlap one another to form the roof arrangement.

2. A roof arrangement in accordance with claim 1 and wherein a spacing of the chords perpendicular to their elongate length is from three to six times a thickness of said chords.

3. A roof arrangement in accordance with claim 1 and wherein the middle chord has a rectangular box section with the groove members arranged one above another.

4. A roof arrangement in accordance with claim 1 and wherein the upper chord and the lower chord have identical spacing from the middle chord.

5. A roof arrangement in accordance with claim 1 and wherein the interconnecting members include oblique stiffening struts.

6. A roof arrangement in accordance with claim 1 and wherein the lattice girder is symmetrical about the medial elongate chord.

7. A roof arrangement in accordance with claim 1 and including a plurality of upper groove members and a plurality of lower groove members;

one upper and one lower groove member extending to one side of said lattice girder and one upper groove and one lower groove member extending to an opposite side of said lattice girder.

8. A roof arrangement in accordance with claim 1 and including connection struts extending normally between the elongate chord members.

9. A roof arrangement in accordance with claim 1 and including mating plug connectors at distal ends of the chord members securing said lattice truss members one to another.

10. A roof arrangement in accordance with claim 1 and wherein the lattice girder is configured forming a peak of the roof.

11. A roof arrangement in accordance with claim 1 and including an upper groove member, a lower groove member, and a medial groove member therebetween.

12. A roof arrangement in accordance with claim 1 and wherein said groove members are attached to the medial chord member.

13. A roof arrangement in accordance with claim 1 and wherein said tarpaulins are arranged one above another.

14. A roof arrangement in accordance with claim 1 and wherein one of said groove members extends for a different distance along the lattice girder than the other of said groove members.

15. A roof arrangement in accordance with claim 1 and wherein said lattice girders form the peak of the roof;

and a first tarpaulin extends across a peak of said roof in an upper groove member and at least two tarpaulins extend on said lower groove member in overlapping relation from the first groove member.

16. A roof arrangement suspending a plurality of tarpaulins in overlapping arrangement between a plurality of parallel side-by-side lattice girders, each said tarpaulin having at least a central tarpaulin expanse and paired parallel edges, each of the paired parallel edges having pipings for defining expanded thickness to the tarpaulin expanse at the edges thereof;

said lattice girders comprising:

an upper elongate chord;

a lower elongate chord underlying the upper elongate chord;

a medial elongate chord disposed between the upper elongate chord and the lower elongate chord;

interconnecting members extending between the upper elongate chord, the lower elongate chord and the medial elongate chord for fastening said members into the lattice girder;

at least an upper groove member attached to the lattice girder opening at least to one side of the lattice girder to receive and retain a first tarpaulin piping with the tarpaulin extending from the groove member; and, at least a lower groove member attached to the lattice girder opening at least to the one side of the lattice girder to receive and retain a tarpaulin piping with the tarpaulin extending from the groove member.

17. A lattice girder in accordance with claim 16 wherein a spacing of the chords perpendicular to the longitudinal extent of the lattice girder amounts to from three to six times a thickness of the medial chord perpendicular to its elongate length.

18. A lattice girder in accordance with claim 16 wherein the upper groove member and the lower groove member are attached to the medial elongate chord and the medial elongate chord has a box section.

19. A lattice girder in accordance with claim 16 wherein the upper elongate chord and the lower elongate chord are an equal distance from the medial elongate chord.

20. A lattice girder in accordance with claim 16 wherein the interconnecting members include oblique stiffening struts.

21. A lattice girder in accordance with claim 16 wherein the girders are mirror symmetrical about the medial elongate chord.

22. A lattice girder in accordance with claim 16 including a plurality of upper groove members and a plurality of lower groove members and wherein one upper groove member extends to one side of the lattice girder and the other upper groove member extends to an opposite side of the lattice girder member and the one lower groove member extends to one side of said lattice girder member and the other groove member extends to the opposite side of the lattice groove member.

23. A lattice girder in accordance with claim 16 including vertical connection mounting struts extending between the groove members.

24. A lattice girder in accordance with claim 16 including plug connectors at distal ends of the chord members enabling the lattice girders to be connected in end-to-end relationship.

25. A lattice girder in accordance with claim 16 wherein said lattice girder forms a peak of a roof.

26. A lattice girder in accordance with claim 16 wherein a medial groove member is placed between the upper groove member and the lower groove member.

27. A lattice girder in accordance with claim 16 wherein the groove members are attached to the medial chord member.

* * * * *